343-756
3/4/86 OR 4,574,287 SR

United States Patent [19]
Waters

[11] Patent Number: 4,574,287
[45] Date of Patent: Mar. 4, 1986

[54] FIXED APERTURE, ROTATING FEED, BEAM SCANNING ANTENNA SYSTEM

[75] Inventor: William M. Waters, Millersville, Md.

[73] Assignee: The United States of America as represented by the Secretary of the Navy, Washington, D.C.

[21] Appl. No.: 472,330

[22] Filed: Mar. 4, 1983

[51] Int. Cl.[4] ..... H01Q 19/195
[52] U.S. Cl. ..... 343/756; 343/781 P; 343/761
[58] Field of Search ..... 343/753–756, 343/779, 761, 781 R, 781 P, 781 CA, 840, 839, 909, 837

[56] References Cited

U.S. PATENT DOCUMENTS

| | | | |
|---|---|---|---|
| 2,975,419 | 3/1961 | Brown | 343/839 |
| 2,976,533 | 3/1961 | Salisbury | 343/755 |
| 3,490,021 | 1/1970 | Hogg et al. | 343/703 |
| 3,562,753 | 2/1971 | Tanaka et al. | 343/781 CA |
| 3,688,311 | 8/1972 | Salmon | 343/756 |
| 3,771,160 | 11/1973 | Laverick | 343/756 |
| 3,820,116 | 6/1974 | Carlsson et al. | 343/756 |
| 3,916,416 | 10/1975 | Lewis | 343/756 |
| 4,203,105 | 5/1980 | Dragone et al. | 343/781 P |
| 4,223,316 | 9/1980 | Drabowitch | 343/781 P |
| 4,253,100 | 2/1981 | Commault et al. | 343/756 |
| 4,274,098 | 6/1981 | Renau et al. | 343/781 CA |
| 4,339,757 | 7/1982 | Chu | 343/781 P |
| 4,343,004 | 8/1982 | Ohm | 343/781 P |

*Primary Examiner*—Eli Lieberman
*Assistant Examiner*—Michael C. Wimer
*Attorney, Agent, or Firm*—Robert F. Beers; William T. Ellis; Vincent T. Pace

[57] ABSTRACT

A beam scanning antenna system that uses a small, rapidly rotatable feed antenna to illuminate a large, fixed secondary collimating device, such as a reflector or electromagnetic lens, which in turn illuminates a large, fixed primary collimating device. The primary collimating device forms a narrow collimating beam that is reflected or transmitted into space. Rotation of the small feed antenna causes the beam to scan.

7 Claims, 6 Drawing Figures

FIXED APERTURE, ROTATING FEED, BEAM SCANNING ANTENNA SYSTEM

BACKGROUND OF THE INVENTION

The present invention relates generally to antennas for radar and radio communications which may be positioned in angle, and more particularly to radar and radio communications antenna systems with large fixed apertures, which have integral means for rapidly scanning the beam formed by the large fixed aperture.

Modern radar and communications systems often require antenna beams which can be rapidly positioned in angle (i.e. scanned) in order to provide surveillance and tracking of multiple radar targets or to sequentially contact multiple communications terminals. Greater scanning speed is desirable since it permits an increase in the target handling capacity of a radar system or of the number of communications terminals which can be accessed in a given time period. Existing methods for scanning a radar or radio beam usually have some undesirable limitation with regard to scanning speed.

In most antenna systems the beams are scanned by moving the entire structure (viz. feed and reflector) as a unit. The main problem with such antenna systems is that scanning speed is severely limited simply by the inertia of the structure. In such antenna systems scanning speed can only be increased by either a reduction in size or an increase in locomotive power. The former, however, can result in undesirable performance limitations (e.g. reduction in range), while the latter can result in an incremental increase in cost which is disproportionate to any benefit gained.

Other mechanical approaches to increasing scanning speed include moving the feed in the focal plane of the antenna aperture and moving only the reflector. Moving only the feed mandates that the feed be translated in the focal plane of the aperture. Furthermore, scanning speed is still limited by the inertia of the feed structure.

Moving a reflector large enough to scan the beam saves little over moving the entire antenna mount. U.S. Pat. No. 3,771,160, Laverick, and U.S. Pat. No. 3,562,753, Tanaka et al. disclose antennas wherein scanning is accomplished by moving a large reflector. However, increased scanning speed is not an object of either of those patents.

Scanning speed could be increased by deploying a plurality of feeds across the focal plane of the antenna aperture. Such a configuration is shown in U.S. Pat. No. 3,688,311, Salmon (claim 5 and FIG. 2). Scanning would be accomplished by switching among the many feeds. However, such a configuration would be very expensive due to the additional electronic equipment necessitated by such an arrangement.

Other electronic approaches to large aperture beam scanning have been developed. Among these are array-type antennas such as phased-arrays and frequency-scanned-arrays. In a phased-array the beam scan angle is controlled by phase shifters. While these phased-arrays are fast, they are also very expensive.

In a frequency-scanned-array the beam scan angle is controlled by changing the frequency about a center frequency. Frequency scanning, however, is complicated by the large frequency spectrum necessary to scan a reasonable angular sector. Thus frequency scanning is bandwidth limited. Furthermore, even if wide bandwidth were available, the use of frequencies for other purposes, such as electronic counter-countermeasures or accurate range measurement and resolution, would be precluded. See, Skolnik, *Introduction to Radar Systems* 312 (McGraw-Hill 1962).

U.S. Pat. No. 4,203,105, Dragone et al. utilizes a scanning array feed in an offset reflector antenna arrangement. The effect of such a configuration is to magnify the image of the beam emitted by the array feed. There are, however, certain limitations even to this arrangement.

First of all, feed arrays are very expensive compared to single feeds. Second, Dragone et al. utilizes paraboloidal reflectors. It is well known that paraboloids with small f/D ratios have narrow image planes. Thus, for the arrangement shown in FIG. 1 of Dragone et al., beam spreading at 10 beamwidths off the axis would reduce gain by 25–30%.

OBJECTS OF THE INVENTION

Accordingly, it is an object of this invention to increase the scanning rate of radar and radio beams formed by large, fixed aperture antennas, over presently possible mechanical alternatives.

It is a further object of this invention to increase the scanning rate of radar and radio beams formed by large, fixed aperture antennas, but less expensively than present electronic scanning methods.

Various other objects, advantages, and novel features of the present invention will become apparent from the detailed description of the invention, which follows the summary.

SUMMARY OF THE INVENTION

The above and other objects are realized in the present invention which includes a small feed antenna capable of rapid rotation, and primary and secondary devices for collimating an incident beam of electromagnetic energy. These primary and secondary collimating devices may take on various forms. For example, in one embodiment the primary and secondary collimating device may comprise two reflectors. In another embodiment the primary collimating device may comprise an electromagnetic lens and the secondary collimating device may comprise a reflector. While in yet another embodiment both collimating devices may comprise electromagnetic lenses.

The small rotatable feed antenna and the primary and secondary collimating devices are positioned relative to each other such that a beam of electromagnetic energy from the feed antenna is received by the secondary collimating device. The secondary collimating device in turn either reflects or transmits the energy toward the primary collimating device such that the entire receiving surface of the primary collimating device is illuminated. A narrow collimated beam is formed by this primary collimating device which in turn is either reflected or transmitted into space. Rotation of the feed antenna will cause the beam formed by the primary collimating device to scan through an angle which is proportional to the angle of rotation of the feed antenna.

DETAILED DESCRIPTION OF THE INVENTION

Figure 1:
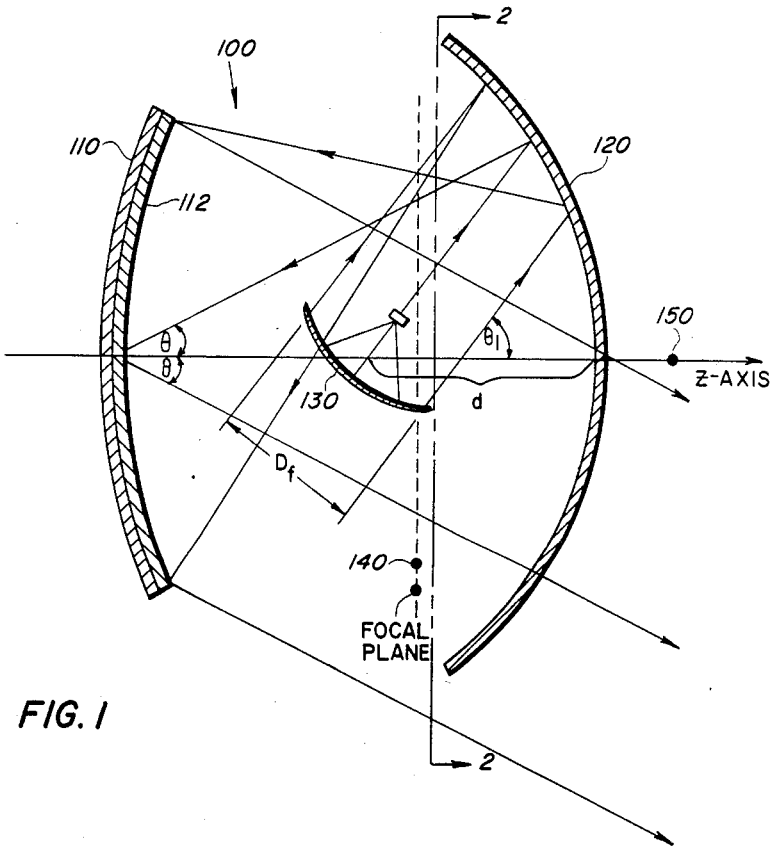
FIG. 1 is a sectional side view of the two-reflector embodiment of the antenna system of the present invention.

Referring now to the drawings, wherein like reference numerals designate identical or corresponding parts throughout the several views, and more particularly to FIG. 1, there is shown a beam scanning antenna system 100. The beam scanning antenna system 100 has a primary collimating device 110, a secondary collimating device 120 and a small rotatable feed antenna 130. In the embodiment shown in FIG. 1 the primary collimating device 110 is realized by a reflector. Likewise, the secondary collimating device 120 is realized by a reflector also.

The primary reflector 110 has a spherical curvature of radius R. The secondary reflector also has a spherical curvature but of radius $R_1$. Both reflectors 110 and 120 are fixed in positions and do not move during operation of the antenna system 100.

The primary reflector 110 and the secondary reflector 120 are positioned such that they have a common focal plane 140 and a common axis 150. The small rotatable, feed antenna 130 is located a distance d, which is approximately $(R_1/2)(1+R_1/R)$ along the common axis 150 from the secondary reflector 120.

The small, rotatable, feed antenna 130 can be any type of collimating antenna device such as a parabolic-dish antenna. The aperture of this small, rotatable feed antenna 130 must be large enough to collimate the beam emitted, so that it does not diverge appreciably prior to incidence on the secondary reflector 120. Since the small, rotatable feed antenna 130 is not located at the geometrical center of the sphere determined by the secondary reflector 120, the beam column length must be $\geqq(R_1/2)(1+R_1/R)$. in practicalapplication, however, it need never be greater than $R_1$. Thus, for a beam column length of magnitude between $R_1$ and $(R_1/2)(1+R_1/R)$, the diameter, $D_f$, of the feed antenna 130 would be in the range $$\sqrt{\lambda R_1} > D_f > \sqrt{\lambda(R_1/2)(1+R_1/R)}\ ;$$

where λ is the wavelength of the center operating frequency.

In operation, the small, rotatable, feed antenna 130, emits a plane wave of electro-magnetic energy which is received by the secondary reflector 120. When reflected by the secondary reflector 120, the electromagnetic energy illuminates the entire primary reflector 110 and is reflected into space. Since the small, rotatable, feed antenna 130 emits a plane wave and since the primary and secondary reflectors 110 and 120 share a common focal plane, a narrow, collimated beam of electromagnetic energy is formed at an angle, $\theta$, which is approximately equal to $(R_1/R)\theta_1$ where $\theta_1$ is the pointing angle of the small, rotatable, feed antenna 130.

Thus, as the small, rotatable, feed antenna 130 is rotated through the angle $-\theta_1$ to $\theta_1$, about the common axis 150 of the system, the beam reflected by the primary reflector 110 will scan through an angle $\theta$ to $-\theta$. The small, rotatable, feed antenna 130 is capable of fast scanning speeds because of its small physical size. Furthermore, in order for the system to have a useful scan angle range it is necessary that the diameter, $D_f$, of the rotatable feed antenna 130 be substantially smaller than the effective diameter of the secondary reflector 120. Since the size relationship will vary from application to application it is impossible to define an exact ratio. It can be readily seen, however, that the smaller the size of the rotatable antenna 130 relative to the secondary reflector 120, the greater will be the scan angle range.

In the embodiment shown in FIG. 1 there would necessarily be some blocking of the beam of electromagnetic energy by both the secondary reflector 120 and the small, rotatable, feed antenna 130. Blocking by the secondary reflector 120 can be avoided by making it transparent to the beam reflected by the primary reflector 110.

Figure 2:
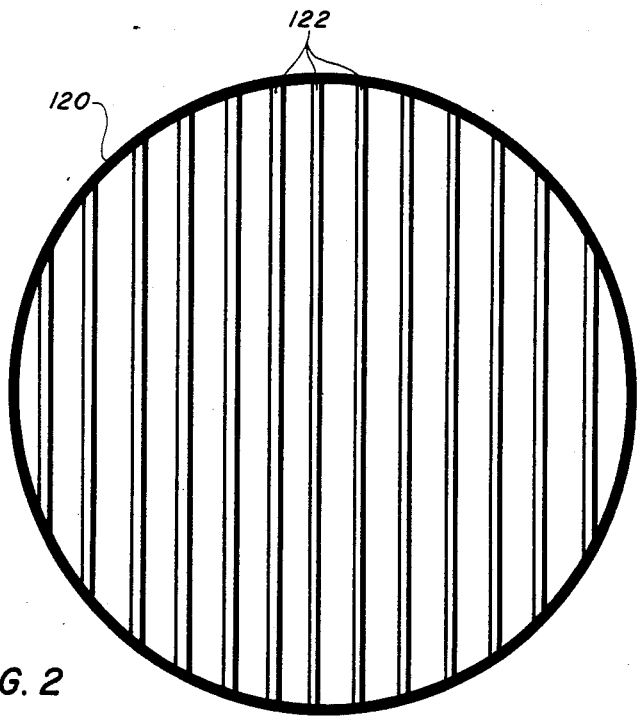
FIG. 2 is view of the secondary reflector depicting the ribbed construction of that reflector.

One method for making the secondary reflector 120 transparent to the reflected beam of the primary reflector 110, is to construct the secondary reflector 120 like the structure shown in FIG. 2, with ribs or wires 122 made of conductive material. The ribs or wires 122 of the secondary reflector 120 must be oriented so that they are parallel to the plane of polarization of the electric field (E-field) of an electromagnetic beam emitted by the small rotatable feed antenna 130. Thus the secondary reflector 120 would reflect the beam of electromagnetic energy emitted by the small rotatable feed antenna.

According to this method the primary reflector 110 is equipped with a twist-reflector 112, for twisting by 90° the polarity of the electic field of the electromagnetic energy incident upon it. Twist-reflectors and reflectors which are transparent to certain polarizations of electromagnetic energy waves are well known in the art. The construction and operation of such devices are further explained in Skolnik, *Introduction to Radar Systems* 242–3 (McGraw-Hill 1980).

Electromagnetic energy reflected by the secondary reflector 120 and incident on the primary reflector 110 has its E-field polarization rotated or twisted by 90° upon reflection at the primary reflector 110. The E-field polarization is then orthogonal to the orientation of the ribs or wires 122 of the secondary reflector 120 and thus passes through the secondary reflector 120 without being blocked.

Figure 3:
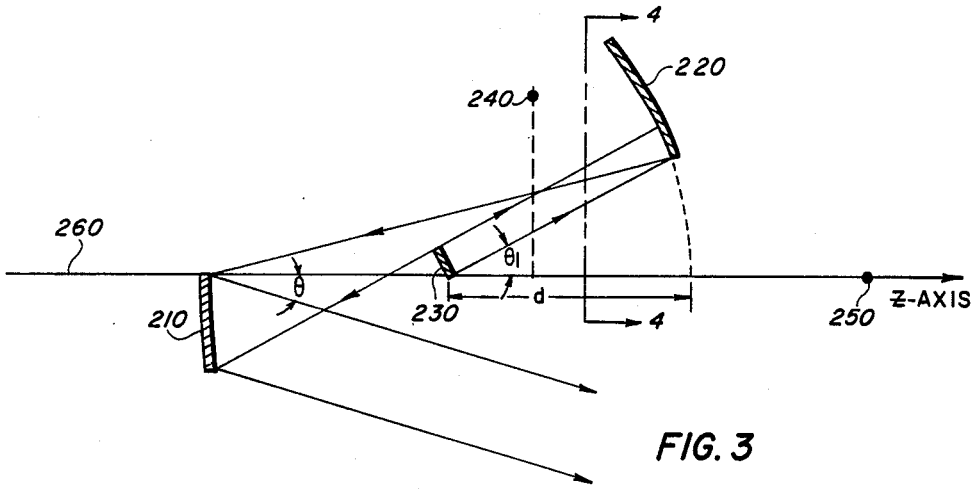
FIG. 3 is a sectional side view of the offset, two-reflector embodiment of the antenna system.

FIG. 3 shows an alternative embodiment of the beam scanning antenna system. In this embodiment the primary collimating device 210 and secondary collimating device 220 are offset relative to each other and to a horizontal plane 260 which separates them. Again, in this embodiment the primary collimating device 210 and secondary collimating device 220 are realized by reflectors. The small, rotatable feed 230 of this embodiment need be disposed only on the same side of the plane 260 as the secondary reflector 220.

Figure 4:
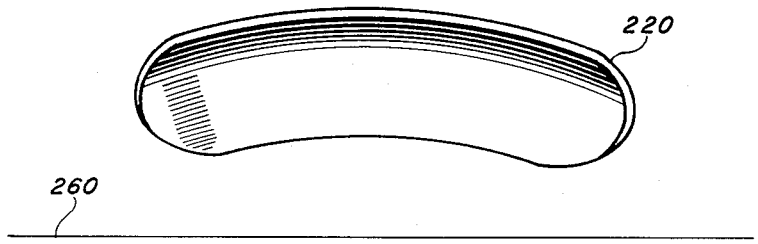
FIG. 4 is a view of the secondary reflector segment as utilized in the offset, two-reflector embodiment.

The primary reflector 210 and secondary reflector 220 are segments of spherical reflectors with radii of curvature R and $R_1$ respectively. The surface of the secondary reflector 220 is approximately as shown in FIG. 4. The primary reflector 210 and secondary reflector 220 are positioned such that they have a common focal plane 240 and a common axis 250.

The difference between this embodiment and that depicted in FIG. 1 is that in FIG. 3 the primary reflector 210 is shortened and the secondary reflector 220 is likewise shortened and also offset above the horizontal plane 260 such that a beam of electromagnetic energy reflected by the secondary reflector 220 will not be blocked by the small rotatable, feed antenna 230. Additionally, since the secondary reflector 220 itself will not block electro-magnetic energy reflected by the primary reflector 210 due to the offset configuration, the polarization twisting mechanism utilized in the embodiment of FIG. 1 is not required. Consequently, the embodiment shown in FIG. 3 is simpler and less costly than that shown in FIG. 1. There is, however, a trade-off in that the beam scanning antenna of FIG. 3 will scan a much more limited angle than that of FIG. 1.

Figure 5:
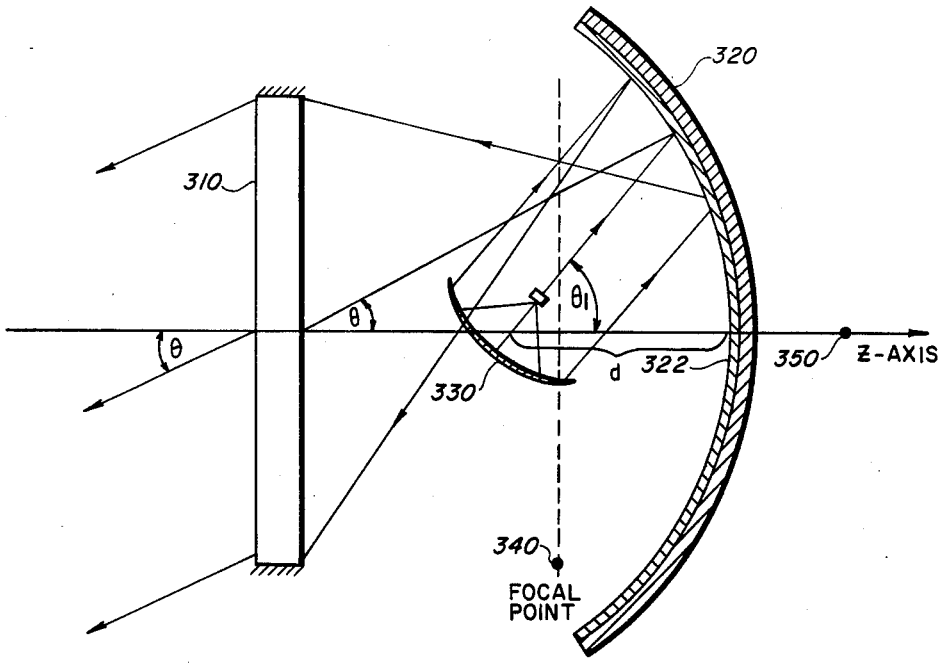
FIG. 5 is a sectional side view of the single lens/single reflector embodiment of the antenna system of the instant invention.

FIG. 5 shows another embodiment of the beam scanning antenna system. In this configuration an electromagnetic lens 310 is used in place of a primary reflector. There are a number of electromagnetic lenses which may be utilized to implement this embodiment. By way of example, the electromagnetic lens 310 may be either the variable thickness dielectric sheet type or the "bootlace" transmission-line type lens, both of which are well known in the art. The electromagnetic lens 310 has a focal length, f, equal to R/2 where R is the radius of curvature of a spherical reflector with the same focal length.

Since a beam of electromagnetic energy reflected by the secondary reflector 320 passes through the lens 310, only the small rotatable feed 330 presents a blocking problem. However, this blocking can be avoided by employing a polarization twisting mechanism 322, as previously discussed, on the secondary reflector 320, in conjunction with a small rotatable feed antenna 330 which has a ribbed construction.

Figure 6:
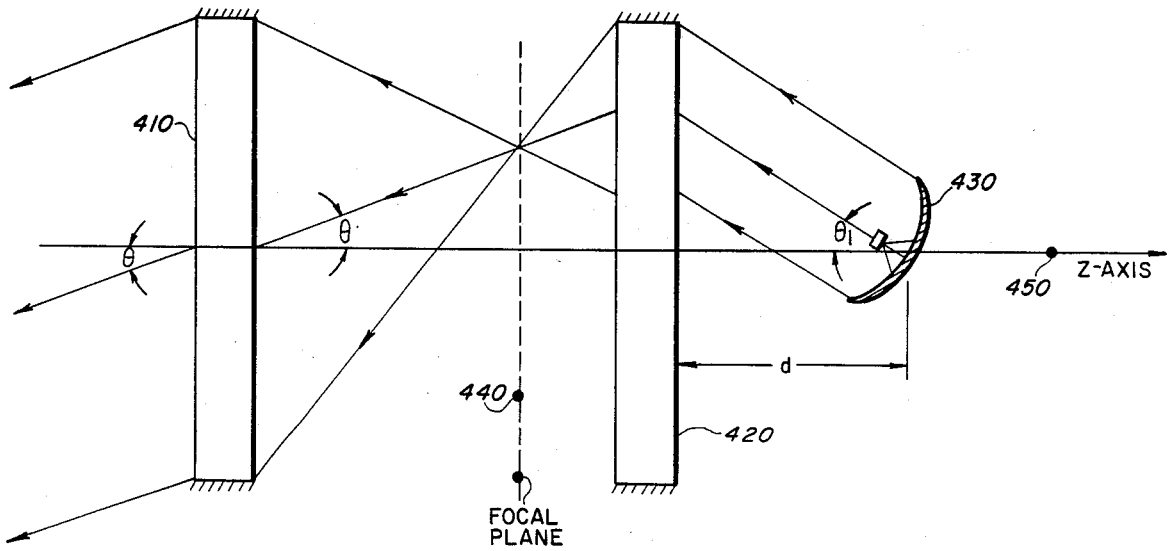
FIG. 6 is a sectional side view of the two-lens embodiment of the antenna system.

FIG. 6 shows a two lens embodiment of the beam scanning antenna system. In this embodiment the primary collimating device 410 and secondary collimating device 420 are realized by use of electro-magnetic lenses. The primary lens 410 and the secondary lens 420 are positioned so as to have a common focal plane 440 and a common axis 450. The primary lens 410 has a focal length, f, equal to R/2, where R is the radius of curvature of a spherical reflector with the same focal length. Likewise, the secondary lens 420 has a focal length, $f_1$, equal to $R_1/2$ where $R_1$ is the radius of curvature of a spherical reflector with the same focal length.

The operation of the two lens embodiment of the beam scanning antenna system shown in FIG. 6 is similar to that for the two reflector embodiment of FIG. 1. The small, rotatable feed, antenna 430 emits a plane wave of electromagnetic energy which is received by the secondary lens 420. The secondary lens 420 transmits the energy in such a manner that the entire surface of the primary lens 410 which faces the secondary lens 420, is illuminated. The electromagnetic energy is then transmitted by the primary lens 410 into space.

Since the small, rotatable feed antenna 430 emits a plane wave, and since the primary and secondary lenses 410 and 420 share a common focal plane, a narrow collimated beam of electromagnetic energy is formed at an angle $\theta$, which is approximately equal to $(f_1/f)\theta_1$, where $\theta_1$ is the pointing angle of the small, rotatable feed antenna 430. Thus, as the small, rotatable feed antenna is rotated through an angle $\theta_1$ to $-\theta_1$, the beam formed by the primary lenses 410 will scan through an angle $-\theta$ to $\theta$.

The small, rotating, feed antenna 430 is located a distance, d, approximately equal to $f_1(1+f_1/f)$ along the common axis from the secondary lens 420. Although the configuration of FIG. 6 eliminates any blocking problem, it is also the most expensive embodiment because it utilizes two electromagnetic lenses.

Obviously, many modifications and variations of the present invention are possible in light of the above teachings. For example, although the embodiments of the present invention as described above assume a generally horizontal antenna orientation, other orientations may be utilized. It is therefore to be understood that, within the scope of the appended claims, the invention may be practiced otherwise than as specifically described.

What is claimed and desired to be secured by Letters Patent of the United States is:

1. A beam scanning antenna system comprising:

a fixed primary reflector for collimating an incident beam of electromagnetic energy, said primary reflector having a generally spherical curvature, a reflecting surface on its concave side, a focal plane and an axis through the vertex of the spherical curvature of said primary reflector, said axis being normal to a plane determined by a circular cross-section of said spherical curvature;

a fixed secondary reflector for collimating an incident beam of electromagnetic energy, said secondary reflector having a generally spherical curvature, a reflecting surface formed of a polarized grid on its concave side, a focal plane, and an axis through the vertex of the spherical curvature of said secondary reflector, said secondary reflector being confocal and coaxial with said primary reflector and being disposed for directing a beam of electromagnetic energy toward the reflecting surface of said primary reflector, and a rotatable antenna having a surface area smaller than said secondary reflector, said rotatable antenna being disposed for directing a collimated beam of electromagnetic energy toward the reflecting surface of said secondary reflector, whereby a beam of electromagnetic energy emitted by said rotatable antenna will scan the reflecting surface of said secondary reflector.

2. A beam scanning antenna system as recited in claim 1 wherein:

said primary reflector has a radius of curvature, R;

said secondary reflector has a radius of curvature, $R_1$; and said rotatable antenna is located at a distance $d=(R_1/2)(1+R_1/R)$ from the secondary reflector, measured along the common axis of said primary and secondary reflectors, such that said rotatable antenna is situated between said primary and secondary reflectors.

3. A beam scanning antenna system as recited in claim 2 wherein said primary reflector further comprises means for twisting by 90° the polarization of electromagnetic energy incident on its reflecting surface, and said secondary reflector further comprises means for making it transparent to electromagnetic energy whose polarization has been twisted by the polarization twisting means of said primary reflector.

4. A beam scanning antenna system as recited in claim 3 wherein the means for making the secondary reflector transparent to electromagnetic energy whose polarization has been twisted by the polarization twisting means of said primary reflector comprises a conductive, ribbed structure as the secondary reflector, said ribbed structure having its ribs oriented orthogonally to the plane of polarization of the energy reflected from the primary reflector.

5. A beam scanning antenna system as recited in claim 4 wherein the rotatable antenna is a small parabolic dish antenna.

6. A beam scanning antenna system as recited in claim 5 wherein the rotatable antenna has a diameter, $D_f$ such that $$\sqrt{\lambda R_1} > D_f > \sqrt{\lambda (R_1/2)(1 + R_1/R)} ,$$

where λ is the wavelength of the center operating frequency of the electromagnetic energy emitted by said rotatable antenna.

7. A beam scanning antenna system comprising:

a fixed primary reflector having a generally spherical curvature, a reflecting surface on its concave side, a focal plane, and an axis through the vertex of the spherical curvature of said primary reflector, said axis being normal to a plane determined by a circular cross-section of said spherical curvature;

said primary reflector having means for twisting by 90° the polarization of electromagnetic energy incident on its reflecting surface;

a fixed secondary reflector having a generally spherical curvature, a reflecting surface on its concave side, a focal plane, and an axis through the vertex of the spherical curvature of said secondary reflector, said secondary reflector being disposed so as to be confocal and coaxial with said primary reflector and to direct a beam of electromagnetic energy toward the reflecting surface of said primary reflector;

said secondary reflector having means for making it transparent to electromagnetic energy whose polarization has been twisted by the polarization twisting means of said primary reflector; and a rotatable feed antenna having a surface area smaller than said secondary reflector, said rotatable antenna being disposed for directing a collimated beam of electromagnetic energy toward the reflecting surface of said secondary reflector, whereby a beam of electromagnetic energy emitted by said rotatable antenna will scan the reflecting surface of said secondary reflector.

* * * * *